US005564908A

United States Patent [19]

Phillips et al.

[11] Patent Number: 5,564,908

[45] Date of Patent: Oct. 15, 1996

[54] FLUID PUMP HAVING MAGNETIC DRIVE

[75] Inventors: Benjamin A. Phillips, Benton Harbor; John Roeder, Jr., Stevensville, both of Mich.; Michael N. Harvey, DeSoto, Tex.

[73] Assignee: Phillips Engineering Company, St. Joseph, Mich.

[21] Appl. No.: 195,193

[22] Filed: Feb. 14, 1994

[51] Int. Cl.[6] ..... F04B 27/053

[52] U.S. Cl. ..... 417/273; 417/415; 417/420; 417/902

[58] Field of Search ..... 417/415, 417, 417/420, 273, 531, 902

[56] References Cited

U.S. PATENT DOCUMENTS

| | | | |
|---|---|---|---|
| 599,487 | 2/1898 | Bailey | 417/273 |
| 2,324,291 | 7/1943 | Dodge | 417/273 |
| 2,399,856 | 5/1946 | Coger | 417/420 |
| 3,396,903 | 8/1968 | Oya | 417/902 |
| 3,420,184 | 1/1969 | Englesberg et al. | 417/420 |
| 3,572,981 | 3/1971 | Pearson | 417/420 |
| 3,584,975 | 6/1971 | Frohbieter . | |
| 3,639,087 | 2/1972 | Frohbieter . | |
| 4,518,326 | 5/1985 | Peruzzi et al. | 417/902 |
| 4,673,337 | 6/1987 | Miller | 417/273 |
| 4,844,707 | 7/1989 | Kletschka | 417/420 |
| 5,030,065 | 7/1991 | Baumann | 417/273 |
| 5,033,940 | 7/1991 | Baumann | 417/273 |
| 5,127,805 | 7/1992 | Fallis et al. | 417/273 |
| 5,180,292 | 1/1993 | Abousabha et al. | 417/273 |

FOREIGN PATENT DOCUMENTS

| | | | |
|---|---|---|---|
| 1564376 | 5/1990 | U.S.S.R. | 417/273 |
| 2272732 | 5/1994 | United Kingdom | 417/273 |

*Primary Examiner*—Timothy S. Thorpe
*Assistant Examiner*—William Wicker
*Attorney, Agent, or Firm*—Finnegan, Henderson, Farabow, Garrett, & Dunner, L.L.P.

[57] ABSTRACT

A pump includes a housing defining a cavity, an axial bore coaxially communicating with the cavity, at least one radial bore radially extending between the cavity and an outlet, and an inlet communicating with the radial bore intermediate to the cavity and the outlet. A crankshaft having a longitudinal axis is disposed in the axial bore for rotation about the axis and includes an eccentric portion disposed in the cavity. A piston having a base is disposed in the cavity, and has a head disposed in the radial bore for slidable reciprocation between a discharge position proximate the outlet and an intake position at the inlet between the cavity and the outlet. A cage structure including a cage and a slider block connects the piston base to the eccentric portion of the crankshaft for transforming rotation of the eccentric portion in the cavity to reciprocation of the piston in the radial bore. A valve structure opens and closes the outlet in response to movement of the piston head between the discharge position to the intake position.

37 Claims, 7 Drawing Sheets

FLUID PUMP HAVING MAGNETIC DRIVE

GOVERNMENT RIGHTS

This invention was made with Government support under contract 86X-17497C awarded by the Oak Ridge National Laboratory for the Department of Energy. The Government has certain rights in this invention.

BACKGROUND OF THE INVENTION

1. Field of the Invention

This invention relates generally to magnetically driven pumps, and, in particular, to magnetically driven solution pumps for use with absorption heat-pump and air conditioning systems.

2. Description of the Related Art

Recent attention has been given to the commercial viability of absorption heat-pump and air conditioning systems, and, in particular, to their use in residential, commercial, and industrial heating and cooling applications. This increased attention has prompted developments in reducing the physical size of such systems, increasing the heating or cooling efficiencies of such systems, and increasing the service life of such systems. As improvements are made to the overall system, individual components are also receiving increased attention and refinements as such contribute to achieving further gains associated with the heat-pump system.

One component of heat-pump systems, the absorption system solution pump, has such a large number of operating requirements and design constraints, especially in smaller tonnage systems using ammonia/water, that few improvements have been made to it by prior artisans. Such solution pumps must be relatively small in size; corrosion resistant, particularly to a solution of ammonia and water; be hermetic; be able to provide a pressure lift of at least 300 psi; be able to pump liquid, vapor or both (and thus have a net positive suction head (NPSH) of zero); be free from wear even if exposed to abrasive particles; and ideally have a relatively long service lifetime of approximately 60,000 to 80,000 hours, using no normal lubricants. Although pumping devices are known which may provide one or more of these features or abilities, none are known which provide this combination of features.

Service lifetime is one factor contributing to the commercial success of a heat pump. Service lifetime refers to the time period that a pump may operate without any maintenance. When pumping devices are incorporated into larger packaged systems, such as absorption heat-pump systems, the pumping device should have a service life at least as long as the packaged system, as replacement of the pumping device often requires disassembly of the system. Competitive heat-pump systems are often expected to operate up to 20 years or 60,000 hours of operation without significant maintenance. Thus, the need exists for a pumping device which has a service life of at least 60,000 to 80,000 hours.

In addition, fluid pumps utilized in absorption heat-pump systems employing an ammonia and water solution are particularly susceptible to interior corrosion (or other chemical reactions) from prolonged exposure to the solution. Further, corrosion problems-may arise upon the addition of certain salts or other additives to such ammonia and water systems for increasing the range of system operating temperatures, or on operating the pumps at higher temperatures than the normal 80°–30° F. Thus, the need exists for a pumping device which is relatively resistant to corrosion or other chemical reactions with the solutions of ammonia and water and potential additives.

In heat-pump systems utilizing an ammonia and water solution, the pumping device must have an NPSH equal to zero because the pump will commonly be exposed to an incoming solution at or near its boiling point. If the pressure of a liquid at the pump inlet is less than the NPSH of a normal pump, the solution will at least partially vaporize, causing destructive cavitation of the pump interior. Moreover, in this pump, an NPSH of zero is necessary because the pump will be required to pump vapor along with the liquid under most of its operating conditions. The pump must also be free from the possibility of leaks and have high efficiency.

SUMMARY OF THE INVENTION

The present invention overcomes many of the shortcomings of the prior art by providing a substantially maintenance-free, corrosion resistant, hermetic pump for use in absorption heat-pump systems. The pump is small in size, provides a pressure lift of over 300 psi, pumps both liquid and vapor, and has a long service lifetime.

Additional advantages of the invention are set forth in part in the description which follows, and in part will be obvious from the description, or may be learned by practice of the invention.

The advantages of the invention may be realized and attained by means of the instrumentalities and combinations particularly pointed out in the appended claims.

In accordance with the invention, the pump includes a housing defining liquid inlet ports, a cavity, a vertical axial bore coaxially communicating with the cavity, at least one radial bore radially extending between the cavity and an outlet, and an inlet communicating between the liquid inlet port and the radial bore at an intake position between the cavity and the outlet. A crankshaft having a longitudinal axis is journalled in the axial bore for rotation about the axis and includes an eccentric portion disposed in the cavity. A piston has a base at one end located in the cavity and a head at the other end in the radial bore for slidable reciprocation between a discharge position proximate the outlet and an intake position between the cavity and the inlet. A slider block and cage structure connects the piston base to the eccentric portion of the crankshaft for transforming rotation of the eccentric portion in the cavity to reciprocation of the piston in the radial bore. A valve structure closes the outlet in response to movement of the piston head from the discharge position to the intake position.

In a preferred embodiment, the cage structure comprises a slider block rotatably mounted on the eccentric portion of the crankshaft, and a cage slidably coupling the base of the piston to a surface of the slider block.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of the specification, illustrate embodiments of the invention, and, together with the description, serve to explain the principals of the invention. In the drawings.

DESCRIPTION OF THE PREFERRED EMBODIMENT

Figure 1:
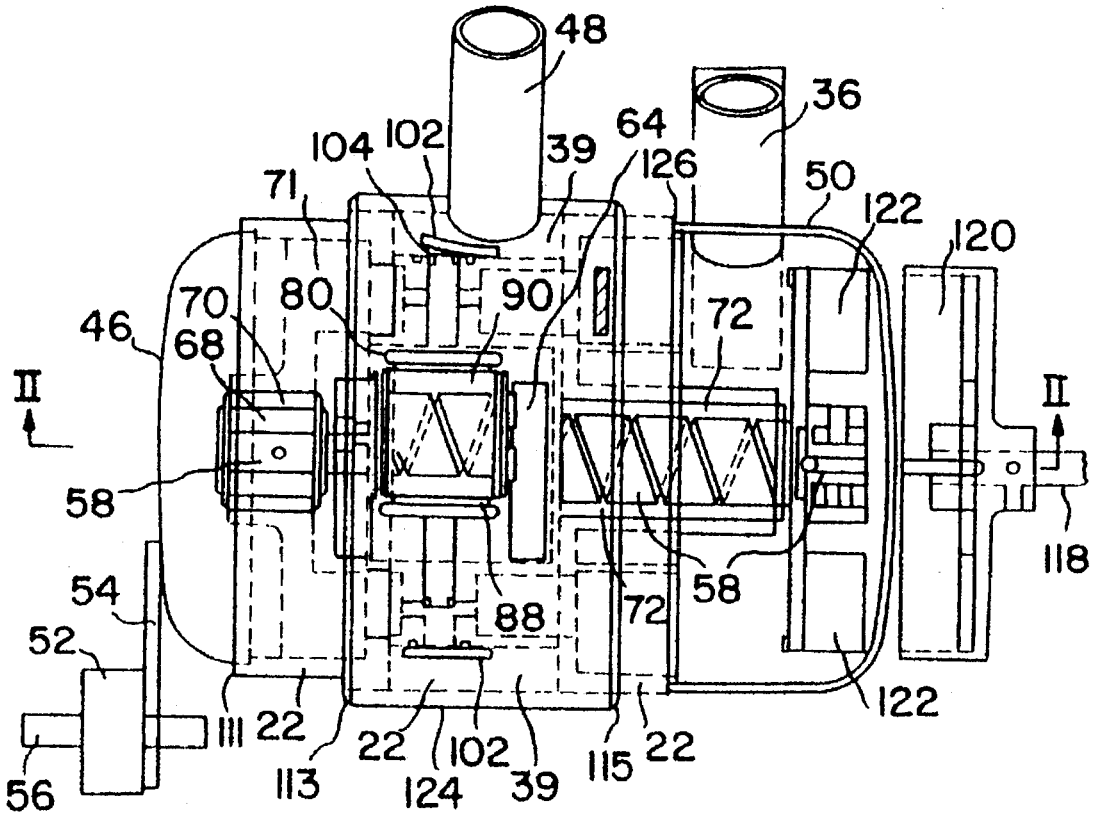
FIG. 1 is an elevational view of a solution pump of the present invention with a cross-section of interior components illustrated in phantom lines.

Reference will now be made in detail to the present preferred embodiments of the invention, examples of which are illustrated in the accompanying drawings.

In accordance with the invention, the pump comprises a housing defining a cavity, an axial bore coaxially communicating with the cavity, at least one radial bore radially extending between the cavity and an outlet, and an inlet communicating with an intake port and with the radial bore between the cavity and the outlet. As embodied herein and depicted in FIGS. 1–6, housing 22 defines a cavity 24 and an axial bore 26 coaxially communicating with cavity 24. A radial bore 28 extends between cavity 24 and an outlet 30. A radial bore inlet 32 is situated between cavity 24 and outlet 30 and communicates with radial bore 28 and inlet port 40. The housing has a bearing housing 71 attached to the main part for holding a second bearing, described below.

In a preferred embodiment for a specific size heat pump, housing 22 defines four radial bores 28, each spaced ninety degrees from the others. Housing 22 has a generally hollow interior defined by an interior surface 34. Laterally disposed to each radial bore 28 are radial bore inlets 32 formed in housing 22 which allow fluid communication between the interior of radial bore 28 and intake port 40 which receives overflow liquid from channel 35 after it enters through pump inlet tube 36 illustrated in FIG. 1. Each radial bore 28 has an outlet 30 at its outermost end proximate to the housing exterior surface 38. Providing fluid communication between each radial bore inlet 32 and pump inlet tube 36 is a plurality of first inlet ports 40 and a plurality of second inlet ports 42, also formed in pump housing 22. A collar 44 coaxially extending from housing 22 defines axial bore 26 for receiving and supporting the crankshaft, explained below. The preferred choice of material for housing 22 is a mild steel or cast iron. The interior surfaces of radial bores 28 should be smooth, with a good finish. Bearing sleeves can be of a suitable bearing material. Carbon graphite has been found to perform well and have a long life.

Figure 3:
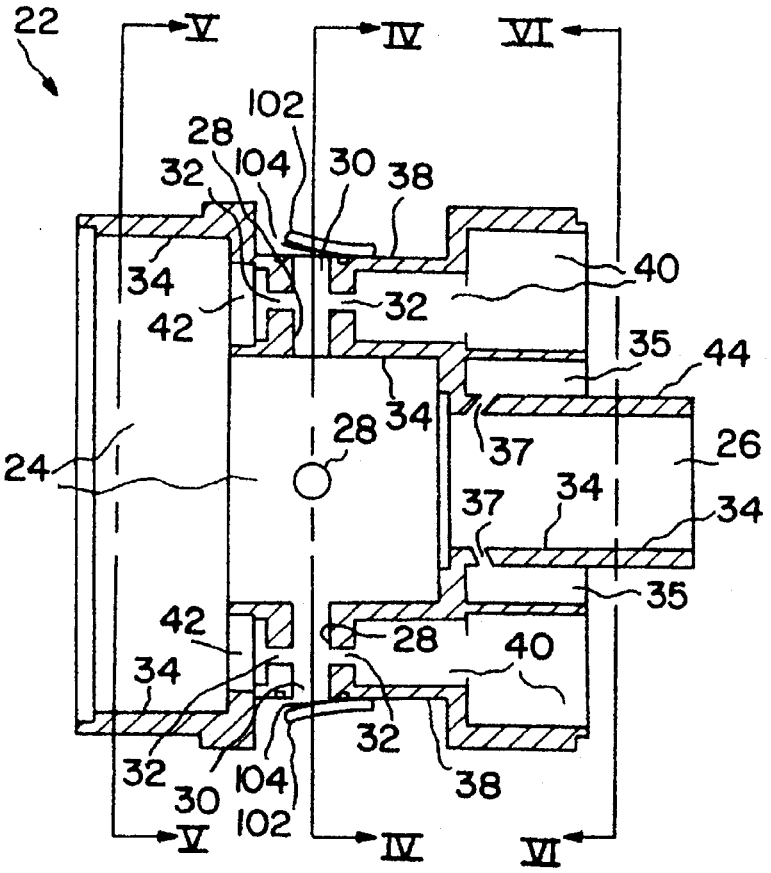
FIG. 3 is an enlarged view of the housing depicted in FIG. 2.
Figure 4:
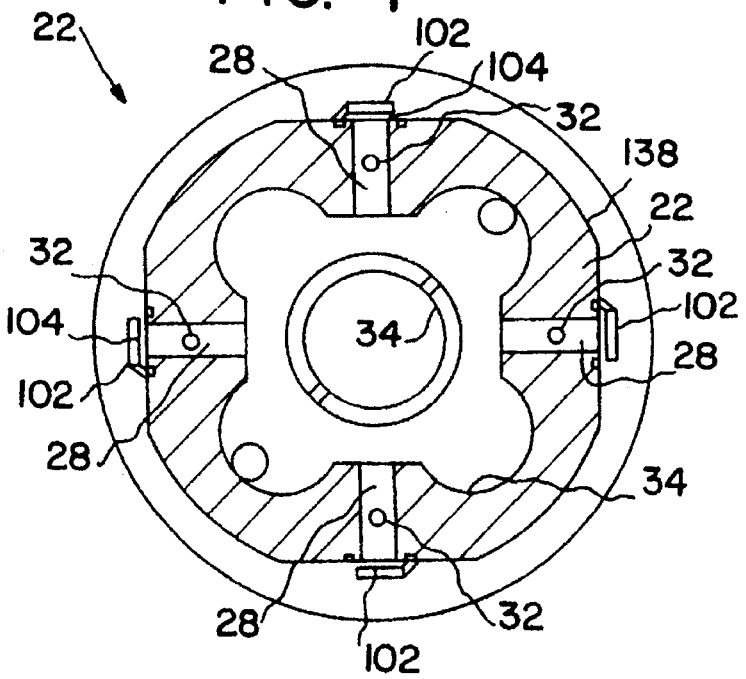
FIG. 4 is a sectional view taken along plane IV—IV of the pump housing illustrated in FIG. 3.

FIG. 4 is a sectional view of pump housing 22 taken along plane IV—IV of FIG. 3. Housing 22 has two pairs of radially-opposed, coaxial cylindrical bores 28, the axes of the two pairs of bores perpendicularly intersecting at a point on the elongated axis of housing 22. FIG. 4 illustrates the relatively open interior of housing 22 defined by interior surface 34. For each radial bore 28, one of two radial bore inlets 32 is shown.

Figure 5:
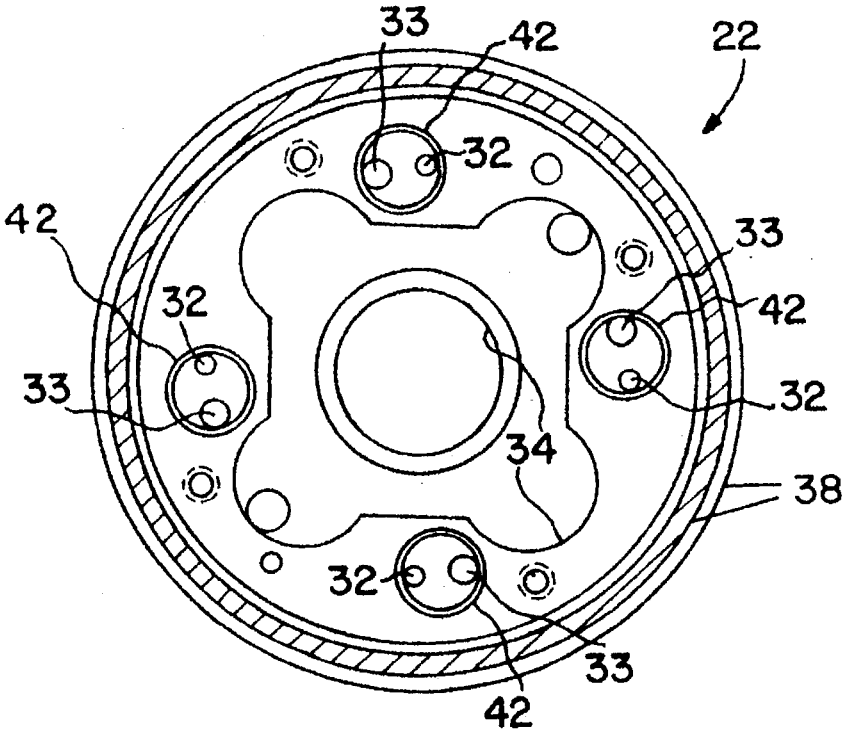
FIG. 5 is a sectional view taken along plane V—V of the pump housing illustrated in FIG. 3.

FIG. 5 is a sectional view of pump housing 22 taken along plane V—V of FIG. 3. Optional second inlet ports 42 are illustrated which allow fluid flow to the underside of radial bores 28. The fluid flows from inlet ports 40 to inlet ports 42 through passages 33. Ports 42 are sealed from cavity 24 of FIG. 3 by plug discs pressed in the ends of ports 42.

Figure 6:
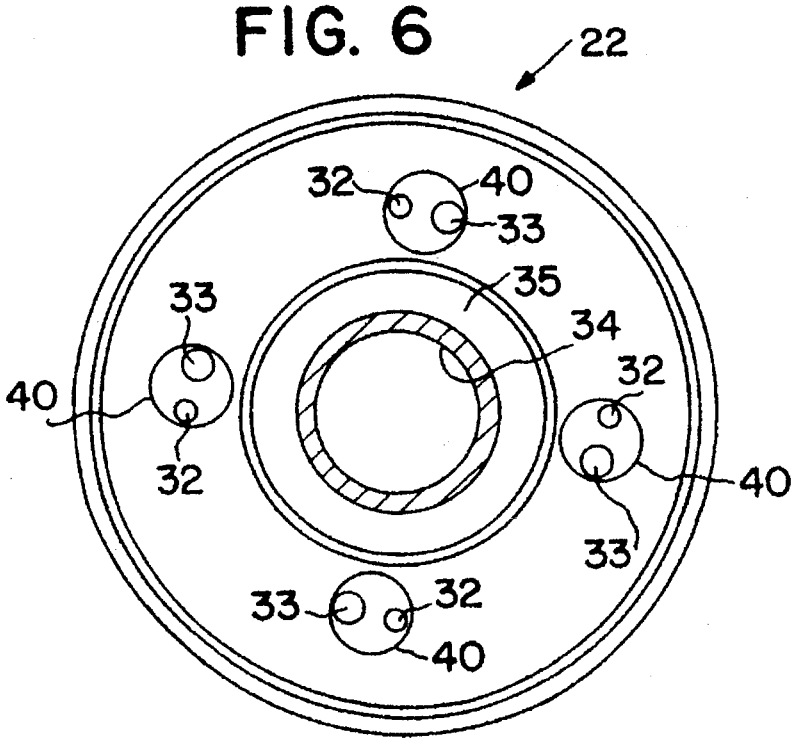
FIG. 6 is a sectional view of the pump housing illustrated in FIG. 3 taken along plane VI—VI.

FIG. 6 is a sectional view of pump housing 22 taken along plane VI—VI of FIG. 3. Inlet solution flows into channel 35 from pump inlet tube 36, and overflows into first inlet ports 40 which allow fluid flow from the first end the pump to radial bores 28 through radial bore inlets 32. Illustrated connecting passages 33 lead to second inlet ports 42 and inlets 32.

Figure 7:
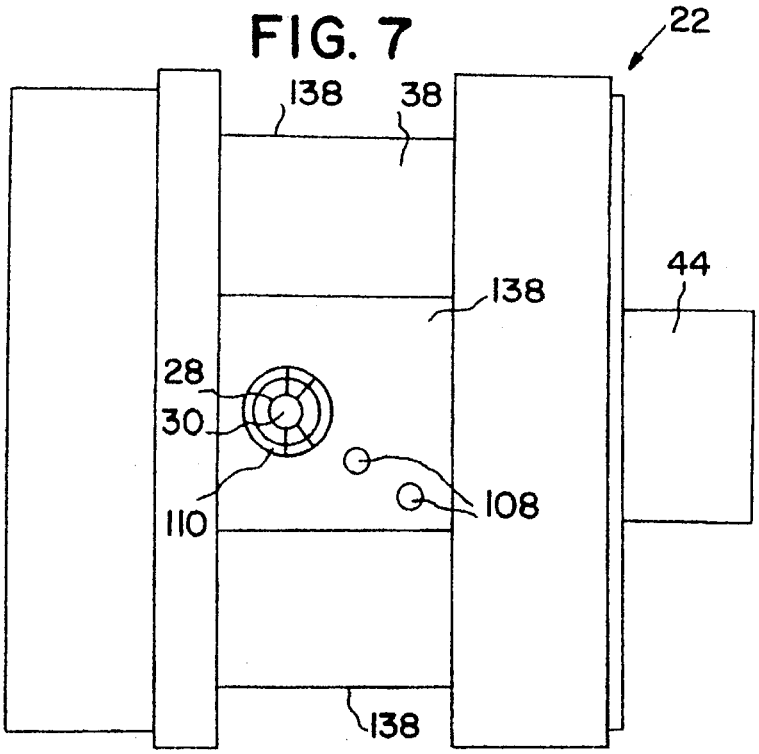
FIG. 7 is an elevational view of the housing illustrating the configuration of a radial bore and a valve.
Figure 9:
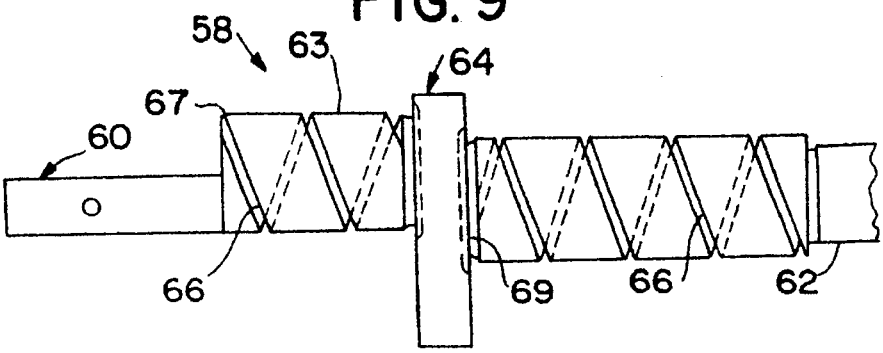
FIG. 9 is an elevational view of the crankshaft illustrated in FIG. 8.
Figure 8:
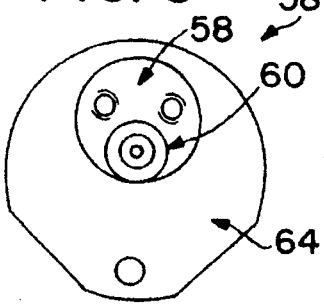
FIG. 8 is an end view of a crankshaft of the pump of the present invention.

In FIG. 7, the preferred arrangement of radial bore 28 on the pump housing 22 is illustrated. A part 138 of housing external surface 38 around the periphery of each radial bore 28 is machined and ground so it is flat and smooth, not cylindrical like the rest of surface 38 of pump housing 22.

The pump may be made hermetic by locating pump housing 22 and all other internal pump components, including the interior magnet, in a welded hermetic casing with inlet and outlet connections. Preferably, the pump can also be made hermetic by using housing 22 as part of the hermetic casing. As shown in FIG. 1, housing 22 is designed so that three covers 46, 50, 124 may be welded to it to provide a hermetic enclosure. First cover 50 encloses the internal magnet and upper portions of the pump. First cover 50 is made of a non-magnetic material, preferably stainless steel, which will have minimal effects on a magnetic coupling between inner and outer magnets, explained below. First cover 50 is welded to pump housing 22 by an equatorial weld at 126. Second cover 46 encloses the bottom of the pump and is welded to pump housing 22 by a circumferential weld at 111. Third cover 124 forms the cylindrical discharge chamber 39 by being welded to pump housing exterior surface 38 at circumferential welds 113 and 115. Outlet discharge tube 48 is welded at an appropriately located discharge hole on third cover 124. Inlet tube 36 is welded through an appropriately located hole in first cover 50. Inlet tube 36 is placed so that the inlet liquid first enters circular channel 35. Part of the liquid flows through holes 37 (see FIG. 3) to the inlet of bearing 72 (see FIG. 1). The remainder of the liquid overflows channel 35 and enters first inlet ports 40.

The pump is supported by three mounting arms 54, with vibration absorbers 52 and locator pins or screws 56.

In accordance with the invention, the pump comprises a crankshaft having a vertical longitudinal axis journalled in the axial bore and bearings for rotation about the axis, the crankshaft including one or more eccentric portions disposed in the cavity. As embodied herein and illustrated in FIGS. 1, 2, 8, and 9, crankshaft 58, including axially opposed first and second ends 62, 60, is received in axial bore 26 of pump housing 22. Intermediate ends 60 and 62, crankshaft 58 includes eccentric portion 63 and counterweight 64. Crankshaft 58 also has at least one helical groove 66 extending along portion(s) of crankshaft 58. The preferred choice of material for crankshaft 58 is a hardened steel having a further hardened nitrided surface. Suitably hardened stainless steel could also be used for crankshaft 58. Preferably, crankshaft 58 may be integrally formed from a solid forged or cast blank of material, or may be assembled from sections.

Figure 14:
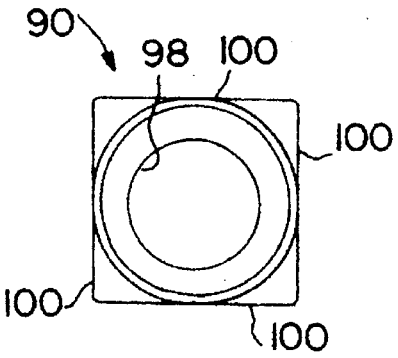
FIG. 14 is an end view of a slider block incorporated in the pump of the present invention.
Figure 15:
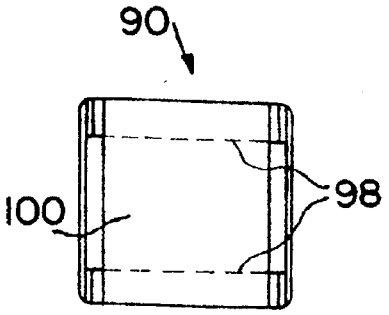
FIG. 15 is an elevational view of the slider block of FIG. 14.
Figure 16:
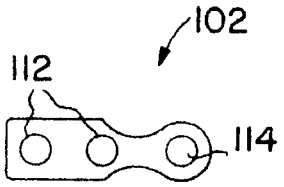
FIG. 16 is a plan view of a valve stop utilized in the pump of the present invention.

Eccentric portion 63 is offset from the axis of rotation of crankshaft 58 by a distance between the cylindrical axis of eccentric portion 63 and axis of crankshaft. The extent of this offset generates the path of motion for a slider block 90 (described in detail below in reference to FIGS. 14 and 15) and the stroke of the pistons in the pump interior when the crankshaft is rotated.

Helical groove 66 is formed on the journal surfaces of the resulting crankshaft 58 in such a manner that liquid adjacent ends 60, 67, 69 of crankshaft 58, when mounted in housing 22, is directed upwards through the bearings 70, 72 of pump housing 22 and of the slider block as a result of crankshaft 58 rotation. This ensures that liquid is circulated rapidly through the bearings of the pump to provide lubrication and cooling during pump operation.

Counterweight 64 is formed and/or affixed to crankshaft 58 such that the center of gravity of the entire crankshaft 58 intersects the axis of rotation of crankshaft 58, thereby minimizing any vibration from rotating crankshaft 58. Counterweight 64 may be integral with crankshaft 58 or may be notched or appropriately shaped to allow ease of attachment to crankshaft 58. It is not necessary to subject counterweight 64 to the nitroalloy hardening process.

Figure 2:
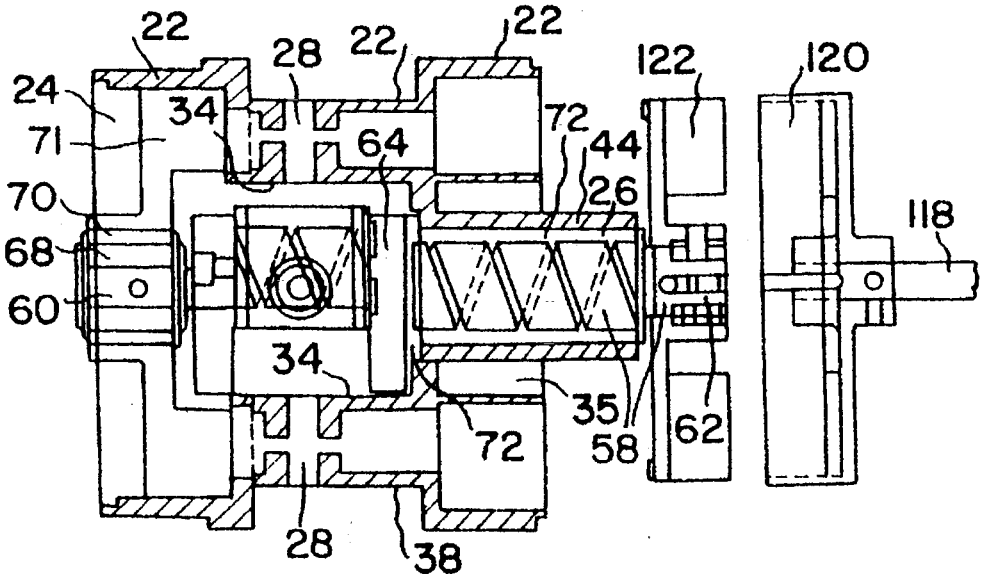
FIG. 2 is a cross sectional view of the interior components of the pump of FIG. 1 taken along line II—II in FIG. 1.

Crankshaft 58 is positioned in pump housing 22 as illustrated in FIGS. 1 and 2. Crankshaft 58 is rotatably supported by a bearing structure including a second bearing 70 and an first bearing 72. The journal sleeve 68 of second shaft end 60 contacts second bearing 70 which, in turn, is supported by bearing housing 71. Second bearing 70 preferably is a journal bearing. The preferred choice of material for second bearing 70 is carbon-graphite. First shaft end 62 and the portion of crankshaft 58 between counterweight 64 and first shaft end 62 are supported by a first bearing 72 residing in collar 44 of pump housing 22. First bearing 72 preferably is a combination journal bearing and thrust bearing. The thrust bearing positions the crankshaft 58 longitudinally. The preferred choice of material for first bearing 72 is carbon-graphite. Being hydrodynamic bearings, both first bearing 72 and second bearing 70 provide a low friction surface for contacting crankshaft 58. Accordingly, both first bearing 72 and second bearing 70 may be secured within pump housing 22 and bearing housing 71 by an appropriate adhesive, or other appropriate manner. First shaft end 62 is securely affixed to an internal magnet comprising a portion of the magnetic drive.

Figure 20:
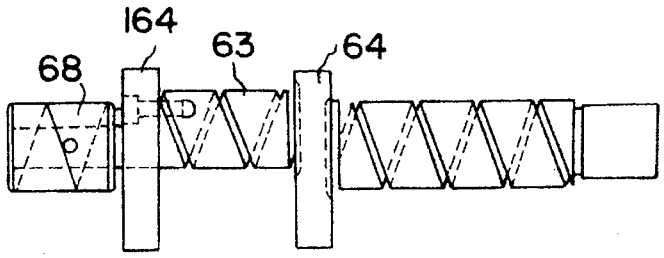
FIG. 20 is an elevational view of an alternate embodiment of the crankshaft.
Figure 17:
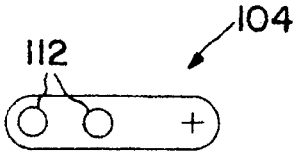
FIG. 17 is a plan view of a valve utilized in the pump of the present invention.

There are advantages in making the second bearing 70 the same diameter as the first bearing 72, as illustrated in the figures. The slider block, however, cannot be installed on the eccentric portion 63 tinless second end 60 of the crankshaft is entirely within a cylindrical space which is an extension of the outside diameter of the eccentric. The slider block is only 0.0005 inches larger in inner diameter than the diameter of the eccentric 63. Second end 60 is thus much smaller in diameter than the journal of first end 62. As shown in FIG. 20, a tightly fitting journal sleeve 68 is therefore pressed and pinned on end 60 of crankshaft 58. Being a journal surface, it also has a groove 66 for flow of the ammonia/water lubricant-coolant. FIG. 20 also shows a second counterweight 164 slid on end 60 and screwed to the eccentric 63. It is envisioned that the pump could be designed to have only one wider counterweight with or without the journal sleeve.

In accordance with the invention, the pump comprises a piston disposed in the radial bore 28 for slidable reciprocation between a discharge position proximate the outlet and an intake position at the liquid inlet 32. As embodied herein and illustrated in FIGS. 1, 2 and 11–14, a piston 74 is slidably received in a respective radial bore 28, and comprises a piston head 76, a piston shaft 78, and a piston base 80 substantially planar in shape. Piston 74 reciprocates linearly and slidably between a discharge position at which piston 74 is positioned proximate to outlet 30 and an intake position at which piston 74 is positioned at inlet 32. An exterior surface 86 of piston base 80, farthest from head 76, contacts the outer surface of a slider block as explained below. Although a square piston base 80 is illustrated in the drawings, such base could also be circular or a variety of other shapes. The choice of material for piston 74 may be any material compatible with the absorption solution, and which has low friction and low wear properties. Such materials include a variety of filled teflons and similar plastics. A preferred choice of material for piston 74 is RULON. Depending upon the choice of materials selected for piston 74, such piston may be formed in one piece or formed separately from different materials and then affixed to one another. Also, depending upon the choice of material selected for piston 74, such may be machined from a material blank, or may be molded.

In accordance with the invention, the piston head has an annular groove to define a lip at the periphery of the head. In a first embodiment of the piston head, illustrated in FIGS. 11, 12, 13, and 14, piston head 76 has a circumferential groove 82 formed on its head end. Such a groove 82 on piston head 76 forms a lip 77 (see FIG. 12) around the perimeter of piston head 76. The lip 77 allows radial expansion of piston head 76, allowing it to flare out when pressure is developed in the cylinder and thereby form an increased seal against the interior wall of radial bore 28. It has been discovered by the present inventors that the discharge pressure of the working fluid being pumped, typically 225 to 300 psia, reached during the discharge stroke of the piston at outlet 30, aids in flaring the lip outward against the interior surface of radial bore 28. This improved sealing effect thus eliminates the requirement of O-rings or piston rings.

Figure 10:
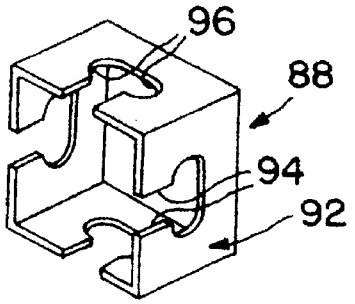
FIG. 10 is an orthogonal view of a cage incorporated in the pump of the present invention.
Figure 11:
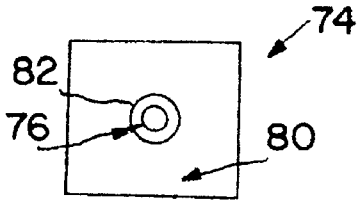
FIG. 11 is a plan view of a first embodiment of a piston of the pump of the present invention.
Figure 12:
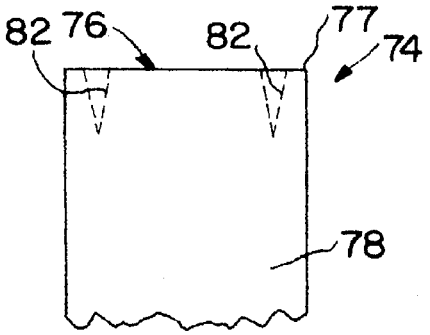
FIG. 12 is an elevational view of a piston head of the piston illustrated in FIG. 11.
Figure 13:
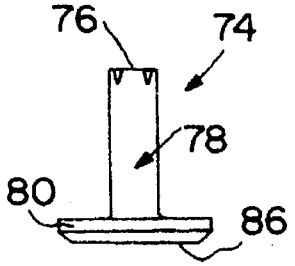
FIG. 13 is an elevational view of the piston illustrated in FIG. 11.

In accordance with the invention, the pump comprises a cage structure connecting the piston base to the eccentric portion of the crankshaft for transforming rotation of the eccentric portion in the cavity to reciprocation of the piston in the radial bore. As embodied herein and shown in FIGS. 10 and 19, a cage structure comprises a cage 88 retaining the slider block 90. Cage 88 comprises four side walls 92 defining a chamber of rectangular cross-section having two opposed mostly open ends. Within each side wall 92 is formed a piston shaft access slot 94 and a piston retention slot 96. The preferred choice of material for cage 88 is a stainless steel. Cage 88 may be formed from a flat blank and then appropriately bent and welded. When assembled in the interior of pump housing 22, cage 88 retains slider block 90 and a plurality of piston bases 74.

Slider block 90, illustrated in FIGS. 1.4, 15, and 19, is rectangular in cross-section and has a cylindrical crankshaft bore 98 formed through its interior. When piston bases 80 are assembled in cage 88, each planar face 100 of block 90 contacts exterior surface 86 of a respective piston base 80. When assembled cage 88 is received in pump housing 22, eccentric portion 63 of crankshaft 58 is received in crankshaft bore 98 of slider block 90; rotational motion of eccentric portion 63 is transformed into reciprocation of pistons 74 by slider block 90. The preferred choice of materials for slider block 90 includes carbon-graphite and ceramics. The material selected for slider block 90 should be compatible with the material selected for piston base 80, and particularly for the exterior surface 86, to minimize friction and wear between exterior surface 86 of base 80 and slider block 90.

Figure 19:
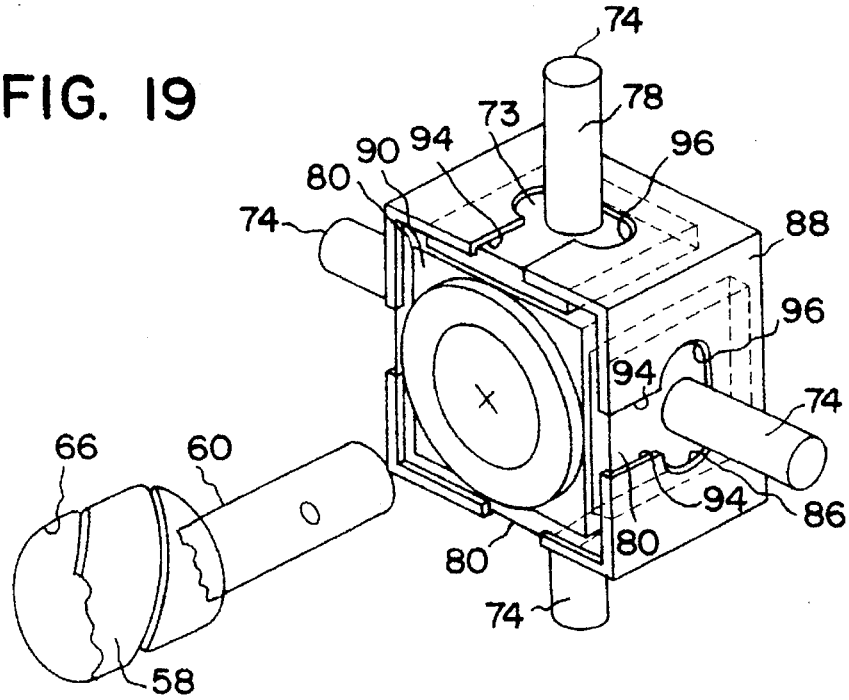
FIG. 19 is an orthogonal view of an assembly comprising the crankshaft, slider block, cage, and pistons of the present invention.

FIG. 19 illustrates the configuration of the plurality of pistons 74, slider block 90, and cage 88 when assembled. Cage 88 has small tabs at the open ends, which are bent over to enclose and lock the pistons and slider block within the cage. In this assembled state, each piston base 80 contacts one of the faces 100 of slider block 90. Contact between base 80 and block 90 is maintained by cage 88 which overlays each piston base. Each piston shaft 78 extends outwardly through a respective piston retention slot 96. Slot 96 preferably has an oval geometry thereby providing each piston shaft 78 an amount of lateral travel, perpendicular to the axis of rotation of crankshaft 58. The length of retention slot 96 formed in side wall 92 is generally proportional to the amount of offset of eccentric portion 63 of crankshaft 58 to the axis of rotation of crankshaft 58. Piston shaft access slot 94 is provided to allow final assembly of the configuration illustrated in FIG. 19.

In accordance with the invention, the pump comprises a valve structure disposed to close the cylinder outlet 30 in response to movement of the piston head from the discharge position to the intake position. As embodied herein and shown in FIGS. 1, 3, 4, 16 and 17, a valve structure is secured over the outlet 30 of each radial bore 28. The valve structure includes a valve stop 102 and a reed valve 104 to close outlet 30 and prevent backward flow of liquid into radial bore 28 through outlet 30. Valve stop 102 and valve 104 serve to limit flow through radial bore 28 to a one-way flow from radial bore 28, through outlet 30, to pump discharge 48. The solution pump is intended for a crankshaft speed of approaching 3600 rpm in order to minimize the size and cost of the pump, the motor, and magnets. That speed requires valve 104 to be able to flex between pump housing 22 and valve stop 102 sixty times per second. This relatively high rate of flex subjects it to potential fatigue failure. The valve reed must therefore be designed to operate at strains below the endurance limit. This requires a combination of material, reed thickness and length, and low curvature of the valve stop.

Preferably, valve 104 is a reed valve formed from a thin strip of a Swedish steel, stainless or carbon, such as those that have proven in use in refrigeration and air conditioning compressors operating at the same speeds. Valve 104 is fixed to pump housing 22 and biased to close outlet 30, but valve 104 is moveable against the bias in response to fluid pressure generated by the movement of piston head 76 toward the discharge position. Valve stop 102 is rigidly affixed over outlet 30 to limit the flexure and travel of valve 104 in response to the fluid pressure between housing exterior surface 38 and valve stop 102. The preferred choice of material for valve stop 102 is a mild steel. FIG. 4 illustrates the ends of valve stops 102 and valves 104, each set positioned over a radial bore 28.

FIG. 7 illustrates fastener holes 108 for valve 104 and valve stop 102. Fastener holes 108 are shown indicating that valve 104 and valve stop 102 may be oriented at any angle from the cylindrical axis of housing 22, approximately 45° in this case. Preferably, the part 138 of housing external surface 38 around the periphery of each set of fastener holes 108 is machined and ground so it is flat and smooth, not curved like the rest of surface 38 of cylindrical housing 22. Both valve 104 and valve stop 102 are provided with fastener holes 112 for passing fasteners through when securing to pump housing 22 at holes 108. Around each outlet 30 is formed a clean-out groove 110. Clean-out groove 110 preferably is circular and concentrically formed around outlet 30, upon the external surface 138 of pump housing 22. This groove provides a relief for any particulate matter which may collect underneath the surface the valve 104 which would otherwise obstruct the seating of valve 104 upon housing external surface 38. Thus, valve 104 is able to effectively seat over outlet 30 and prevent the backflow of liquid into radial bore 28. The present inventors have discovered that without clean-out groove 110 formed around outlet 30, particulate matter may collect around outlet 30 and interfere with the extent of contact between valve 104 and housing surface 138, thereby resulting in a decrease in pumping efficiency.

Figure 18:
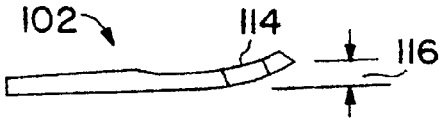
FIG. 18 is an elevational view of the valve stop illustrated in FIG. 16.

As shown in FIG. 18, the end of valve stop 102 having a hole 114 formed therethrough is curved relative to the other end of valve stop 102. When the movable end of valve 104 moves up against valve stop 102, it squeezes out the liquid between the two. It is desired that the valve not be delayed in its movement up and down. Hole 114 is for the purpose of facilitating the flow of liquid out from between the valve and the stop and back in again. When valve stop 102 is affixed over outlet 30, hole 114 should generally be positioned directly over the longitudinal axis of radial bore 28. The angle (exaggerated for purposes of illustration in FIG. 18) at which the end of valve stop 102 deviates from the plane of the opposite end of valve stop 102, is determined by the distance desired for valve clearance 116. The preferred distance for valve clearance 116 is about 0.012 inches.

Solutions of ammonia in water, especially those including inhibitors, rapidly corrode many materials of construction, like copper, aluminum, brass, etc., which are commonly used in present heat pumps and air conditioners. The steels are generally not affected. This solution pump and its components are made of carbon steels and other materials that are not affected by ammonia/water and the inhibitors. The internal motors commonly used in CFC, HCFC and HFC hermetic compressors contain copper, aluminum and other materials affected by ammonia. Therefore it is not possible to use an internal motor in this hermetic pump. A magnetic drive consisting of an internal magnet driven by an external magnet and motor is used in its place. The magnets are made of ceramics or metals not affected by ammonia and water, or inhibitors.

Figure 22:
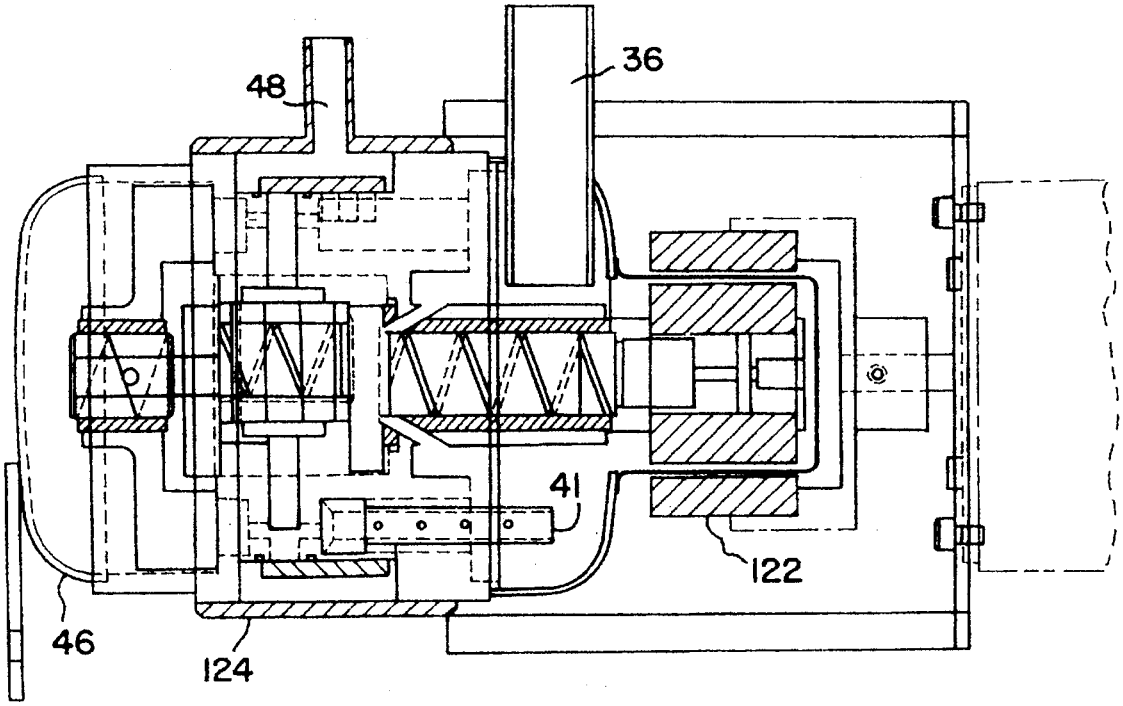
FIG. 22 is an elevational view of the pump with the inlet pipe of FIG. 21.

FIGS. 1 and 2 show an external drive shaft 118 providing power input to the pump by magnetically rotating crankshaft 58. Affixed to drive shaft 118 is at least one external magnet 120 which is placed in sufficient proximity to at least one internal magnet 122 such that the two magnets (internal and external) provide a slip free engagement between one another. Although the magnetic drive embodiment described herein is illustrated as an axial magnetic drive in FIG. 1, a radial magnetic drive as shown in FIG. 22 can also be utilized and is preferred. It is envisioned by the present inventors to incorporate a decoupling detector on the pump exterior which will detect a condition where one of the two magnets is rotating out of sync from the other, or is not rotating at all. When such decoupling occurs, the motor is stopped to permit recoupling and is then restarted.

Figure 21:
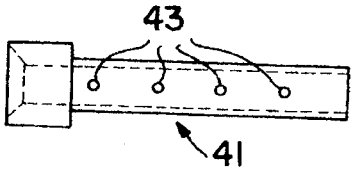
FIG. 21 is an elevational view of an inlet pipe used in the pump.

FIG. 21 illustrates an inlet pipe 41, and FIG. 22 illustrates where the inlet pipe 41 connects into the housing. Each inlet port 40 has one inlet pipe 41 pressed tightly into the bottom of the smaller diameter section of inlet port 40. The purpose of the inlet pipes 41, in combination with inlet port 40, is to prevent vapor-lock of any of the cylinders and to cause rapid recovery if vapor-lock initiates in any cylinder.

Vapor-lock is a common consequence when attempting to pump any boiling liquid, or such a liquid and its vapor. When such vapor-lock occurs in normal pumps, it is usually necessary to turn off the pump, let it cool down, be refilled with liquid, and then restarted. The controls on the heat pump of the present invention will do so if necessary. However, it is preferred to stop vapor lock before it reaches this state, so a series of preventative steps have been built into the design of the pump.

One is the use of multiple pistons. It is unlikely that all pistons will vapor-lock at one time. If one or two of the pistons vapor-lock, the others continue pumping. Because the total liquid flow is less than maximum design flow under most operating conditions when a vapor-lock occurs the pistons still operating may be likely to pump most, or perhaps all, of the inlet liquid from the absorber. This liquid flow through the pump helps cool the vapor-locked cylinder.

Another vapor-lock preventative is storage of inlet liquid in inlet port 40. If a vapor-lock is precipitated by a temporary lack of liquid flow from the absorber, stored liquid in inlet port 40 serves as a continuing source to bridge a temporary lack of flow. The storage of liquid in an inlet port 40 occurs due to the presence of inlet pipe 41. Being pressed into the bottom of inlet port 40, the inlet pipe 41 seals off the flow of liquid to radial bore inlet 32 except for through holes 43, thus causing the liquid to accumulate in the inlet port 40 to a height sufficient for the full flow to pass through holes 43.

The third and fourth methods of preventing or correcting vapor-lock are the dual actions of the inlet pipes 41. The normal action of the inlet pipes 41 is to cause continuous mixing of intake liquid and vapor to the radial bores 28 rather than sequential flow. The mixing occurs by metering the liquid flow through holes 43 into the downward stream of vapor flowing through inlet pipes 41. In operation during most of the year, the volume of vapor intake to the cylinders will be of similar magnitude to that of the liquid. This continuous mixing of liquid with the vapor assures that some liquid always enters the radial bore, rather than vapor only.

The second action of the inlet pipes 41 is to correct immediately a vapor-lock in a radial bore if it occurs. In normal operation, the head that builds up in the inlets 32 radial bores 28 is equivalent to ⅛ to 3/16 inch of liquid at the moment the piston opens the port. If a vapor-lock occurs, fluid entry into the radial bore ends. Vapor flow down the inlet pipe will stop, but the liquid will continue to flow into the inlet pipe through holes 43 in the side, building up a liquid head of 1.5 to 2 inches in less than a tenth of a second. This sudden tenfold rise in head has been found to reduce vapor-locks to a fraction of those normally encountered. It is believed that the combination of these preventative measures will essentially eliminate the need for heat pump controls to temporarily stop operation of the heat pump.

In operation, an external power source provides rotary power to external drive shaft 118. Rotating shaft 118 drives crankshaft 58 via the magnetic drive comprising magnets 120 and 122. Rotating crankshaft 58 causes the assembly of cage 88 and slider block 90 to trace a circular path about the axis of rotation of crankshaft 58, since cage 88 and block 90 are coupled to eccentric portion 63 of crankshaft 58, and thus are offset from the axis of rotation of crankshaft 58. The moving cage and slider block assembly cause each piston 74 to reciprocate in its respective radial bore 28. As crankshaft 58 rotates, cage 88 and slider block 90 do not rotate, but rather follow a circular path around the axis of rotation of crankshaft 58. Distally opposed pistons thus reciprocate in phase with one another in that as a first piston may be at top dead center of its travel and proximate to outlet 30, the piston opposite it would be fully retracted towards the interior of housing 22. As the pistons reciprocate within their radial bores 28, each piston head 76 travels to both radial bore inlets 32. As each piston retracts into its respective radial bore 28 and evacuates the radial bore, working solution enters radial bore 28 through inlets 32. Upon a piston 74 beginning its discharge stroke, traveling outward toward the housing exterior, the piston head 76 travels past inlets 32 thereby sealing off any fluid communication between radial bore 28 and inlets 32, and causes the working solution contained within radial bore 28 to be ejected out through outlet 30. The discharge of working solution through outlet 30 causes valve 104 to flex away from housing 22 and stop against valve stop 102. When the piston head 76 is in its fully extended position, it is virtually flush with the exterior surface 38 of housing 22. The ejected fluid has been directed outwardly into discharge chamber 39 and through pump discharge tube 48 as illustrated in FIG. 1. It is especially preferred that the piston heads 76 are flush with housing external surface 38 when the pistons are in their fully extended position. This ensures that radial bore 28 is completely emptied of any remaining liquid which may still reside in the radial bore interior. Otherwise, such liquid, if allowed to remain in radial bore 28, would evaporate excessively as the piston retracts, and the vapor would decrease the pumping volume by displacing entering work solution and also tend to cause vapor lock. Furthermore, piston head 76 must not extend past housing external surface 38 as such would increase the tendency for head 76 to impact valve 104. When piston 74 begins its inward stroke towards the interior of housing 22, valve 104 springs back and is also pushed by liquid pressure over outlet 30, thus preventing significant flow of working solution into radial bore 28 through outlet 30.

It will be apparent to those skilled in the art that various modifications and variations could be made to the fluid pump of the invention without departing from the scope or spirit of the invention. Thus, it is intended that the present invention cover the modifications and variations of this invention provided they come within the scope of the appended claims and their equivalents.

We claim:

1. A pump comprising:

a housing defining a cavity, an axial bore coaxially communicating with the cavity, at least one radial bore radially extending between the cavity and an outlet, and at least one inlet communicating with the radial bore intermediate to the cavity and the outlet;

a crankshaft having a longitudinal axis disposed in the axial bore for rotation about the axis, the crankshaft including an eccentric portion disposed in the cavity;

a piston having a base disposed in the cavity and a head disposed in the radial bore for slidable reciprocation between a discharge position proximate the outlet and an intake position between the cavity and the inlet;

a coupling structure connecting the piston base to the eccentric portion of the crankshaft for transforming rotation of the eccentric portion in the cavity to reciprocation of the piston in the radial bore;

a valve structure disposed to open and close the outlet in response to movement of the piston head from the discharge position to the intake position; and a drive shaft connected magnetically to the crankshaft.

2. The pump of claim 1 further comprising:

an internal magnet connected to an end of the crankshaft for rotation therewith; and an external magnet proximate to and magnetically coupled to the internal magnet, the external magnet being connected to the drive shaft for rotation therewith.

3. The pump of claim 1 further comprising one or more counterweights affixed to the crankshaft.

4. The pump of claim 1 wherein the housing includes a clean-out groove around the outlet.

5. The pump of claim 1 wherein the coupling structure comprises a slider block rotatably mounted on the eccentric portion and a cage slidably coupling the base of the piston to a surface of the slider block.

6. The pump of claim 5 wherein the cage comprises four side walls defining a chamber of rectangular cross-section having two opposed open ends, each of the side walls having an access slot and a retention slot for retaining the pistons.

7. The pump of claim 1 further comprising a bearing structure disposed in each opposed end of the axial bore for rotatably supporting the crankshaft therein.

8. The pump of claim 7 wherein the crankshaft has a helical groove in the surface thereof for conveying through the bearing.

9. The pump of claim 1 wherein the head of the piston has an annular groove therein defining a lip proximate the periphery of the head.

10. The pump of claim 9 wherein the annular groove is circumferential.

11. The pump of claim 1 wherein the valve structure comprises a flexible, resilient leaf valve fixed to the housing and biased to open and close the outlet, the leaf valve being moveable in response to fluid pressure generated by movement of the piston head to the discharge position.

12. The pump of claim 11 further comprising a valve stop fixed to the housing and disposed to limit motion of the leaf valve in response to the fluid pressure.

13. The pump of claim 12 wherein the valve stop comprises first and second ends, the first end being fastened to the housing, and the second end including a fluid passage and projecting a distance from the housing.

14. The pump of claim 1 further comprising first second, and third covers substantially enclosing the housing.

15. The pump of claim 14 further comprising a pump inlet tube and a discharge tube.

16. The pump of claim 15, wherein the inlet tube is enclosed by the first cover and discharge tube is enclosed by the third cover.

17. The pump of claim 1 wherein the housing includes two pairs of coaxial radial bores each communicating between the cavity and a respective outlet, the axes of the pairs perpendicularly intersecting on the axis of the axial bore.

18. The pump of claim 17 including four pistons, each of the pistons having a head disposed in a respective radial bore.

19. The pump of claim 17 wherein the housing includes four pairs of coaxial inlets, each of the inlets communicating with a respective radial bore.

20. The pump of claim 19 further comprising a pump inlet tube supplying working fluid into the housing.

21. The pump of claim 20 wherein the housing includes four pairs of coaxial inlet ports, each inlet port, providing fluid communication between a respective inlet and the pump inlet tube.

22. A pump comprising:

a housing defining a central cavity, multiple pairs of coaxial radial bores, and multiple outlets at the exterior of the housing, each of the radial bores extending from the central cavity to a respective outlet, each of the radial bores communicating with a pair of inlets situated between the central cavity and each respective outlet;

a crankshaft disposed within the housing, the crankshaft including a counterweight fixed thereto and an eccentric portion disposed within the cavity;

multiple pistons, each of the pistons having a head disposed in a respective radial bore and a base disposed in the cavity;

a slider block mounted on the eccentric portion of the crankshaft;

a cage coupling each piston base to a surface of the slider block;

multiple valves fixed to the housing to open and close each of the outlets; and a drive shaft magnetically connected to the crankshaft.

23. The pump of claim 22 further comprising multiple valve stops fixed to the housing, each valve stop disposed to limit motion of a respective valve.

24. The pump of claim 22 wherein each piston head has an annular groove.

25. The pump of claim 22 wherein the cage includes multiple side walls defining a chamber for containing the slider block, each of the side walls having an access slot for positioning a respective piston base and a retention slot for retaining a respective piston base.

26. The pump of claim 23 further comprising a pump inlet tube providing working fluid into the housing, a pump discharge tube for discharging working fluid from a discharge chamber defined at least partially by the housing, and first, second, and third covers substantially enclosing the housing.

27. A pump comprising:

an inlet tube for supplying working fluid;

a housing defining a central cavity, an axial bore coaxially communicating with the cavity, two pairs of coaxial radial bores, and four outlets at the exterior of the housing, each of the radial bores extending from the central cavity to a respective outlet, each of the radial bores communicating with a pair of inlets situated between the central cavity and each respective outlet, each of the inlets communicating with a respective inlet port, each of the inlet ports providing fluid communication between the inlet tube and a respective inlet;

a crankshaft having a longitudinal axis disposed in the axial bore for rotation about the axis, the crankshaft including at least one counterweight fixed thereto, an eccentric portion disposed in the cavity, and a helical groove in the surface thereof for conveying the working fluid through a bearing;

four pistons, each of the pistons having a base disposed in the cavity and a head disposed in a respective radial bore for slidable reciprocation;

a slider block mounted on the eccentric portion of the crankshaft;

a cage coupling each piston base to a surface of the slider block, the cage including four side walls defining a chamber for containing the slider block, each of the side walls having an access slot for positioning a respective piston base and a retention slot for retaining a respective piston base;

four valves fixed to the housing to open and close each of the outlets in response to movement of the piston head;

four valve stops fixed to the housing, each of the stops disposed to limit motion of a respective valve;

a discharge tube for discharging working fluid from each of the outlets to the exterior of the pump; and a drive shaft magnetically connected to the crankshaft.

28. A pump comprising:

a housing defining a cavity, at least one bore extending between the cavity and an outlet, and at least one inlet communicating with the bore intermediate to the cavity and the outlet;

a crankshaft rotatably mounted in the housing, the crankshaft including at least one eccentric portion disposed in the cavity;

a piston having a base disposed in the cavity and a head disposed in the bore for reciprocation between a discharge position proximate the outlet and an intake position between the cavity and an inlet;

a coupling structure having a crankshaft bore rotatably receiving the eccentric portion of the crankshaft and a portion coupled to the piston base such that rotation of the eccentric portion in the cavity reciprocates the piston in the radial bore;

a valve structure disposed to open and close the outlet in response to movement of the piston head from the discharge position to the intake position; and a magnet connected to the crankshaft for coupling the crankshaft with an external magnetic field capable of rotating the crankshaft.

29. The pump of claim 28 further comprising an inlet tube extending from the bore communicating inlet, the inlet tube having at least one hole positioned along the length thereof, the hole permitting liquid flow into the inlet pipe.

30. The pump of claim 28 wherein the head of the piston reaches the outlet when the piston is in the discharge position such that the piston completely empties liquid from the bore in the discharge position.

31. The pump of claim 28 wherein the housing includes a plurality of bores each extending between the cavity and a respective outlet and having an inlet communicating with the cavity, the pump further comprising a plurality of pistons each having a base coupled to the coupling structure and a head disposed in one of the bores.

32. The pump of claim 28 wherein the valve structure comprises a flexible, resilient leaf valve fixed to the housing and biased to close the outlet, the leaf valve being movable in response to fluid pressure in the bore generated by movement of the piston head to the discharge position.

33. The pump of claim 28, wherein the housing includes bearings at opposed ends of the crankshaft and the crankshaft includes at least one helical groove for conveying fluid through at least one of the bearings.

34. The pump of claim 28 wherein the eccentric portion of the crankshaft includes a helical groove for conveying fluid between the crankshaft and the coupling structure.

35. The pump of claim 28 wherein the magnet is positioned proximate a first end of the crankshaft and the eccentric portion is positioned proximate a second opposite end of the crankshaft.

36. The pump of claim 28 wherein the piston includes a shaft passing through a retention slot in the coupling structure, the retention slot having a geometry allowing the piston to travel in a direction perpendicular to a longitudinal axis of the crankshaft during rotation of the crankshaft.

37. The pump of claim 36 wherein the coupling structure includes a slider block having the crankshaft bore and a cage having the retention slot, the cage coupling the piston base to a surface of the slider block.

* * * * *

UNITED STATES PATENT AND TRADEMARK OFFICE

CERTIFICATE OF CORRECTION

PATENT NO. : 5,564,908

DATED : October 15, 1996

INVENTOR(S) : Benjamin Phillips, John Roeder, Jr., and Michael N. Harvey

It is certified that error appears in the above-indentified patent and that said Letters Patent is hereby corrected as shown below:

Claim 8, col. 11, line 47, after "conveying" insert --fluid--.

Claim 21, col. 12, line 19, delete "," after "port".

Claim 28, col. 13, line 43, change "an" to --the--; and
line 48, delete "radial".

Claim 29, col. 14, line 10, change "pipe" to --tube--.

Signed and Sealed this

Twenty-fourth Day of December, 1996

*Attest:*

Bruce Lehman

BRUCE LEHMAN

*Attesting Officer*

*Commissioner of Patents and Trademarks*